US006572405B2

(12) United States Patent
Lin et al.

(10) Patent No.: US 6,572,405 B2
(45) Date of Patent: Jun. 3, 2003

(54) RF CABLE CONNECTOR ASSEMBLY

(75) Inventors: Hsien-Chu Lin, Tu-Chen (TW); Chieh-Chao Yu, Tu-Chen (TW); Yung-Chien Chung, Tu-Chen (TW); Lung-Sheng Tai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/021,183

(22) Filed: Oct. 30, 2001

(65) Prior Publication Data

US 2003/0040219 A1 Feb. 27, 2003

(30) Foreign Application Priority Data

Aug. 24, 2001 (TW) ..... 90214475 U

(51) Int. Cl.[7] ..... H01R 9/05
(52) U.S. Cl. ..... 439/578; 439/188; 439/353
(58) Field of Search ..... 439/578, 583, 439/585, 188, 350, 345, 352, 353, 675, 180, 94

(56) References Cited

U.S. PATENT DOCUMENTS

| | | | | | |
|---|---|---|---|---|---|
| RE32,864 | E | * | 2/1989 | Ezure | 439/152 |
| 5,556,284 | A | * | 9/1996 | Itou et al. | 439/34 |
| 5,611,707 | A | * | 3/1997 | Meynier | 439/353 |
| 5,921,793 | A | * | 7/1999 | Phillips | 439/188 |

* cited by examiner

*Primary Examiner*—P. Austin Bradley
*Assistant Examiner*—Alexander Gilman
(74) *Attorney, Agent, or Firm*—Wei Te Chung

(57) ABSTRACT

An RF cable connector assembly includes a plug connector (1) and a receptacle connector (2). The plug connector has a skirt (101) formed in a front portion of a body (10) thereof and a socket (13) with an annular raised bead (131). The receptacle connector has a shell (20), and a guide sleeve (200) at a front of the shell. An internal groove (203) is defined at a rear end of the guide sleeve, to engagingly receive with the bead. A distance d2 between a front end (250) of the guide sleeve and a front end of a female contact (23) of the receptacle connector is greater than a distance d1 between the front end of the body and a front end of a male contact (12) housed within the body.

1 Claim, 3 Drawing Sheets

RF CABLE CONNECTOR ASSEMBLY

BACKGROUND OF THE INVENTION

1. Field of the Invention

The present invention relates to RF cable connector assemblies, and especially to RF cable connector assemblies which have means for preventing damage to connectors thereof during coupling of the connectors.

2. Description of the Related Art

A radio frequency (RF) cable connector assembly generally includes a plug connector and a complementary receptacle connector. The plug connector has a male central contact, and the receptacle connector has a female central contact to engage with the male central contact.

Typical connectors in RF cable connector assemblies are very small. Therefore components of the connectors, and particularly the central contacts, are delicate.

In particular, if the central contacts are not aligned with each other upon mating of the connectors, the central contacts are easily damaged. If the central contacts are mated at an angle, the male contact cannot properly engage with the female contact. The male contact may exert lateral force on the female contact. The female contact and also the male contact may be damaged.

U.S. Pat. No. 5,611,707 discloses an RF cable connector assembly intended to solve the abovementioned problem. The RF cable connector assembly comprises a plug connector and a receptacle connector. The receptacle connector has a body, and a cylindrical skirt extending beyond a front end of the body. A distance d2 between a front end of the skirt and a front end of a central contact of the receptacle connector is equal to a distance d1 between a front end of a body of the plug connector and a front end of a central contact housed within the body.

However, because distance d1 equals distance d2, the central contacts engage as soon as the front end of the skirt of the receptacle connector bears on the front end of the body of the plug connector. Therefore, if the front end of the skirt of the receptacle connector is not correctly aligned with the front end of the body of the plug connector, there is still a risk that the central contacts of the connectors will be damaged.

In addition, the skirt of the receptacle connector is coupled to the body of the receptacle connector. This makes manufacture and assembly of the receptacle connector complicated and costly, particularly in view of the very small dimensions and high precision of the connector.

Furthermore, a bead is provided at a front end of a projecting barrel of the plug connector. Yet there is no suitable mechanism for guiding the projecting barrel of the plug connector to enter the skirt of the receptacle connector. Thus there is unduly high risk of the central contacts of the connectors being damaged during mating. Moreover, the shape of the bead does not allow firm engagement of the bead in a corresponding groove defined in the receptacle connector.

Hence it is desired to provide an RF cable connector assembly which can overcome the foregoing drawbacks of the related art.

SUMMARY OF THE INVENTION

A main object of the present invention is to provide an RF cable connector assembly which minimizes the risk of damage to connectors of the assembly during coupling of the connectors.

Another object of the present invention is to provide a cost efficient RF cable connector assembly that is easily assembled.

A further object of the present invention is to provide an RF cable connector assembly which has connectors that mate firmly and with good retaining force.

To achieve the above-mentioned objects, an RF cable connector assembly in accordance with the present invention comprises a plug connector and a receptacle connector. The plug connector has a skirt formed in a front portion of a body thereof, and a socket with an annular raised bead. The receptacle connector has a shell, and a guide sleeve at a front of the shell. An internal groove is defined at a rear end of the guide sleeve, to engagingly receive the bead of the socket of the plug connector. A distance d2 between a front end of the guide sleeve and a front end of a female contact of the receptacle connector is greater than a distance d1 between the front end of the body and a front end of a male contact housed within the body.

For the purpose of making the invention easier to understand, one particular embodiment thereof will now be described with reference to the appended drawings in which:

DETAILED DESCRIPTION OF THE INVENTION

Figure 1:
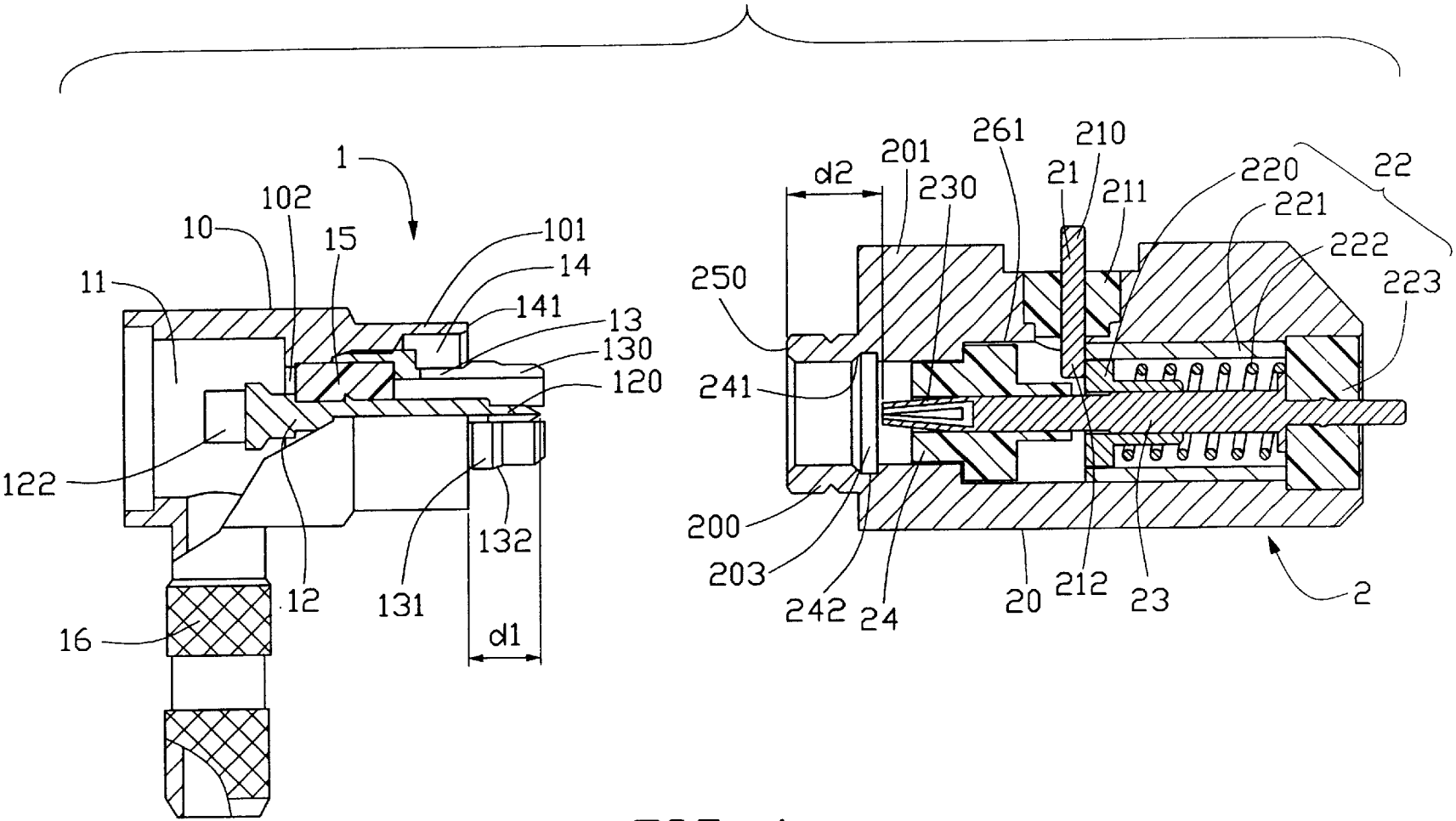
FIG. 1 is a side sectional view an RF cable connector assembly according to the present invention, before coupling of the connectors thereof.

Referring now to the drawings in detail, FIG. 1 shows an RF cable connector assembly according to the invention before coupling. The RF cable connector assembly includes a plug connector 1 and a receptacle connector 2.

The plug connector 1 includes a conductive body 10, a male central contact 12 at a longitudinal axis of the body 10, an insulator 15 interposed between the male contact 12 and the body 10, a projecting ring 102, and an elastic socket 13. The projecting ring 102 is located at a rear end of the insulator 15, to prevent the insulator 15 from moving.

The body 10 is hollow, and is adapted for grounding to an external earthing contact. A cavity 11 is defined in a rear end of the body 10, and a knurled handle 16 depends from one side of the body 10. The body 10 also has an open front end 141. A chamber 14 is defined in the front end 141. A cylindrical skirt 101 surrounds the chamber 14. The skirt 101 is part of an outside wall of the body 10.

The male contact 12 protrudes beyond the front end 141 of the body 10. The male contact 12 has a front engaging pin 120, and a rear solder end 122 for securing to a cable (not shown). A front end of the pin 120 is located a distance d1 from the front end 141 of the body 10.

The elastic socket 13 is disposed forward of the insulator 15, and surrounds a front portion of the male contact 12. The elastic socket 13 comprises an outer guiding portion 130 at a front thereof, and an annular raised bead 131 behind the guiding portion 130. The bead 131 has an outermost circumferential surface, and a pair of circumferential sloped surfaces 132 on opposite sides of the outermost circumferential surface respectively. A diameter of the bead 131 is greater than a diameter of the guiding portion 130. An outermost end of the socket 13 is a very slightly forward of the front end of the pin 120.

The receptacle connector 2 is adapted for grounding to an external earthing contact. The receptacle connector 2 comprises a hollow conductive shell 20, a female contact 23 having a contact socket 230 at a front end thereof, an insulative slide block 24 interposed between the shell 20 and the front end of the contact socket 23, and an elastic module 22 received in a rear of the shell 20. The contact socket 230 is complementary to the pin 120 of the plug connector 1.

An interior of the receptacle connector 2 forms a pipe-shaped rail 261, for slidably receiving the slide block 24 therein. The female contact 23 extends through the slide block 24 and the elastic module 22. A switch contact 21 extends through an outer wall 201 of the shell 20. The switch contact 21 has a solder portion 210 for soldering to a printed circuit board (PCB) or an electronic device and attaining signal transmission. An insulative partition 211 is interposed between the outer wall 201 and the switch contact 21.

The elastic module 22 of the receptacle connector 2 comprises a pipe-shaped guiding rail 221, a conductive piston 220, a spring 222 surrounding the piston 220, and an insulative tail 223. The conductive piston 220 and the spring 222 are received in the guiding rail 221, such that the piston 220 can slide within the guiding rail 221. A lower end 212 of the switch contact 21 contacts a front end surface of the piston 220, to electrically connect with the piston 220.

A guide sleeve 200 is formed at the front end of the shell 20. The guiding sleeve 200 has a front end 250, and an internal annular groove 203 at a rear end thereof. The front end 250 is located a distance d2 from a front end of the contact socket 230. The distance d2 is greater than the distance d1 defined on the plug connector 1 between the front end of the pin 120 of the male contact 12 and the front end 141 of the body 10. The groove 203 is bounded by a slanted surface 241 of an inside of a rear end of the guide sleeve 200, and by a step surface 242 of an interior wall of the shell 20.

In the present invention, the receptacle connector 2 also has an appropriate construction (not shown) for securing a cable (not shown) thereto. Such construction is well known to persons skilled in the art. Therefore a detailed description of such construction is omitted herefrom.

Figure 2:
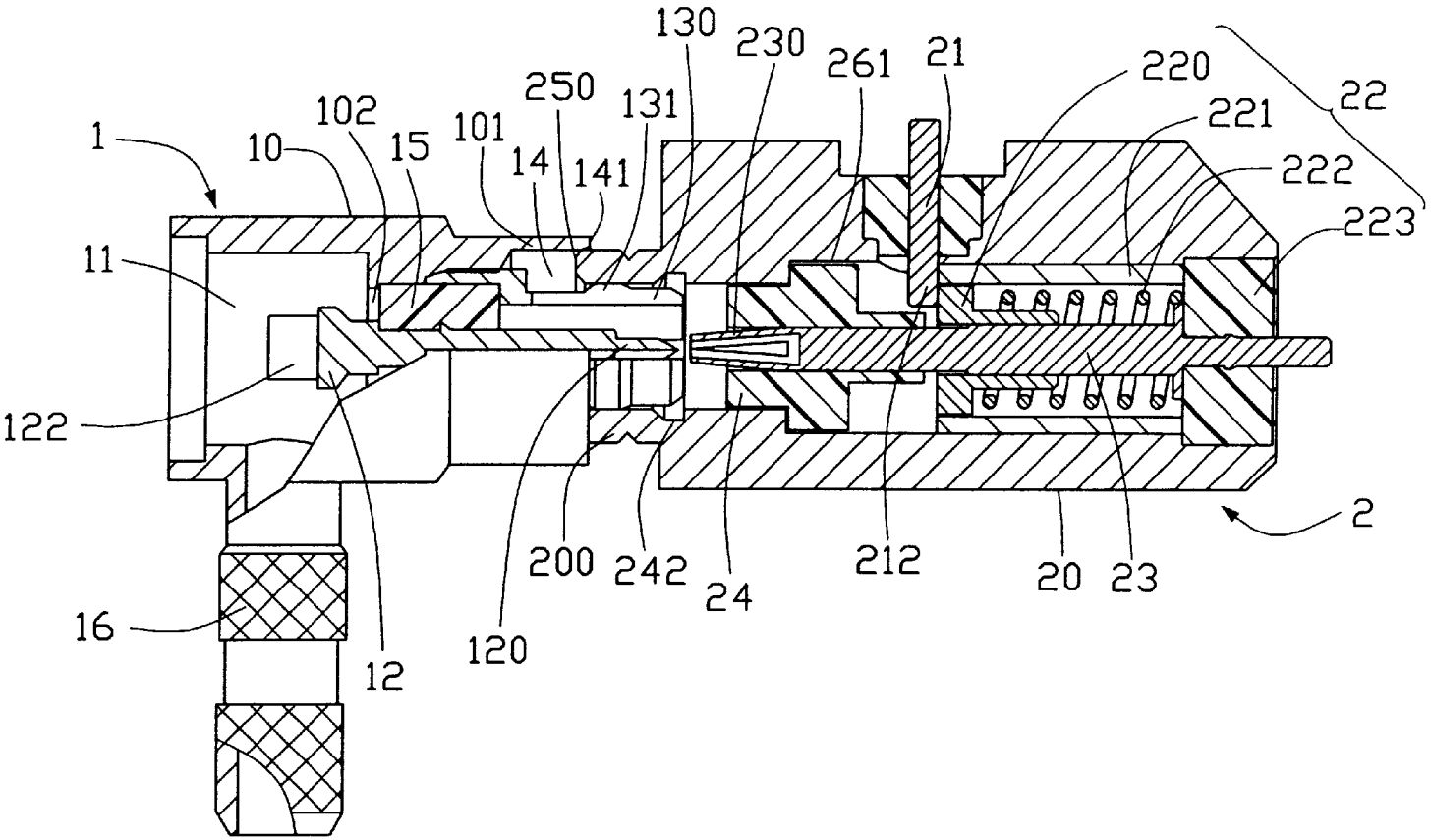
FIG. 2 is similar to FIG. 1, but showing the connectors in the process of coupling.

FIG. 2 shows a process of coupling the plug connector 1 with the receptacle connector 2. First, the elastic socket 13 of the plug connector 1 is inserted into the guide sleeve 200 of the receptacle connector 2, until the front end 250 of the guide sleeve 200 starts to enter the chamber 14 of the plug connector 1. Then, the skirt 101 and the bead 131 of the plug connector 1 elastically engage with the guide sleeve 200 of the receptacle connector 2. Accordingly, the plug connector 1 and the receptacle connector 2 become aligned with each other, thus ensuring accurate engagement of the male contact 12 with the female contact 23. In addition, because the distance d2 is greater than the distance d1, the male contact 12 of the plug connector 1 does not engage with the female contact 23 of the receptacle connector 2 until after the plug connector 1 and the receptacle connector 2 have become aligned with each other. Thus coupling can be continued without risk of damaging the male or female contacts 12, 23, until the plug connector 1 and the receptacle connector 2 have reached a coupled state as illustrated in FIG. 3.

Figure 3:
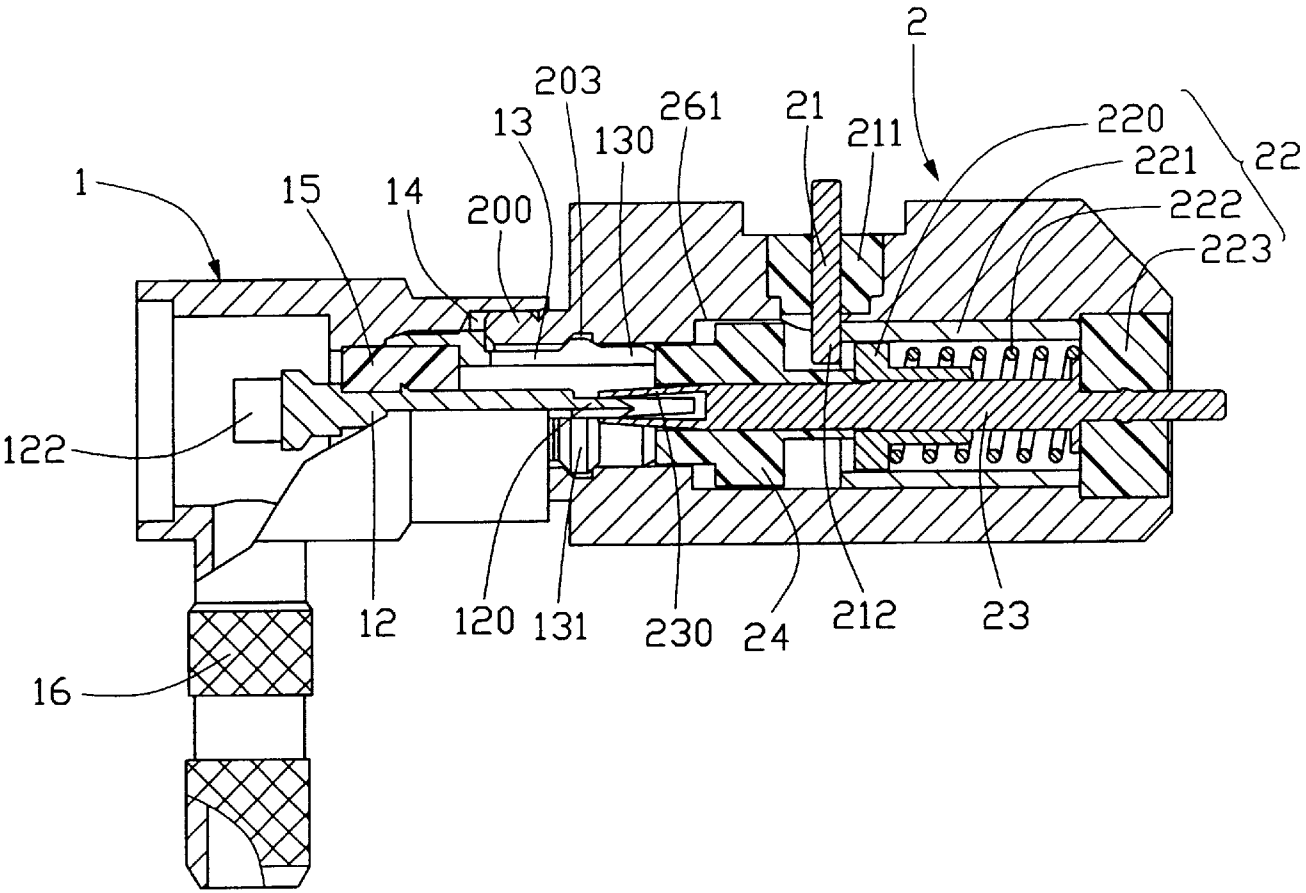
FIG. 3 is similar to FIG. 2, but showing the connectors fully coupled.

FIG. 3 shows the RF cable connector assembly in the coupled state. The bead 131 of the elastic socket 13 of the plug connector 1 is received in the groove 203 of the receptacle connector 2. The guide sleeve 200 of the receptacle connector 2 is received in the chamber 14 of the plug connector 1. In reaching the coupled state, the elastic socket 13 presses the slide block 24 backwards, the slide block 24 presses the piston 220, and the piston 220 compresses the spring 222. Therefore, not only does the slide block 24 make the piston 220 disconnect from the switch contact 21, but the elastic module 22 also cushions the engagement of the male and female contacts 12, 23 to prevent them from being damaged.

Although the present invention has been described in conjunction with a particular embodiment, it is quite obvious that the present invention is in no way limited to the particular embodiment, and that various alternatives and modifications can be made to the particular embodiment without in any way departing from either the scope or spirit of the present invention.

I claim:

1. A cable connector assembly comprising:

a first connector comprising a conductive body with a tubular socket circumferentially enclosing a first male contact therein at a front end portion of said first connector;

a skirt circumferentially enclosing said socket except for a front portion of said tubular socket;

a second connector comprising a conductive shell circumferentially enclosing a second female contact therein; and a guiding sleeve extending forward at a front end portion of said conductive shell of the second connector; wherein said second connector further includes a slide block in a front portion thereof and an elastic module in a rear portion thereof;

during mating, a front portion of the guiding sleeve is first engaged with the skirt for aligning the first contact and the second contact before said contacts are engaged with each other, and the front portion of the tubular socket successively pushes the slide block to move backward to expose more portions of the second contact for more and for preventing damage of the mating contacts interconnection between the first contact and the second contact.

* * * * *